US005647293A

United States Patent [19]

Price et al.

[11] Patent Number: 5,647,293

[45] Date of Patent: Jul. 15, 1997

[54] LOCKER PATCH ATTACHMENT SYSTEM

[75] Inventors: Elvin C. Price, Dacula; Preston B. Dasher, Buford; Erie G. Huddleston, Lawrenceville, all of Ga.

[73] Assignee: Atlanta Attachment Co., Lawrenceville, Ga.

[21] Appl. No.: 566,115

[22] Filed: Nov. 30, 1995

Related U.S. Application Data

[60] Provisional application No. 60/003,712, Sep. 8, 1995.

[51] Int. Cl.[6] ..... D05B 21/00

[52] U.S. Cl. ..... 112/470.17; 112/475.04; 112/475.09; 112/308

[58] Field of Search ..... 112/470.17, 475.04, 112/475.09, 309, 148, 308, 320

[56] References Cited

U.S. PATENT DOCUMENTS

| | | | |
|---|---|---|---|
| 2,359,713 | 10/1944 | Kessler et al. | 112/470.17 |
| 4,019,447 | 4/1977 | Blessing et al. | 112/308 X |
| 4,181,085 | 1/1980 | Conner, Jr. | 112/308 X |
| 4,593,636 | 6/1986 | Schips | 112/308 |
| 4,648,337 | 3/1987 | Mall | 112/308 X |
| 4,776,579 | 10/1988 | Romand et al. | 112/308 X |
| 5,018,462 | 5/1991 | Brocklehurst | 112/121 |
| 5,119,745 | 6/1992 | Terry | 112/470.17 |
| 5,251,557 | 10/1993 | Rohr | 112/306 |
| 5,529,004 | 6/1996 | Porter et al. | 112/475.04 X |

*Primary Examiner*—Paul C. Lewis

*Attorney, Agent, or Firm*—Thomas, Kayden, Horstemeyer & Risley

[57] ABSTRACT

A locker patch attachment system (30) for attaching a locker patch (10) having an arcuate edge (12) to a garment (11) by sewing about the arcuate edge of the locker patch as the garment and locker patch are automatically pivoted about a sewing machine (32) by a patch pivot assembly (70) and a body pivot assembly (105). The patch pivot assembly (70) and body pivot assembly (105) rotate at the same angular speed and about the common axis α which is displaced from the needle (22) of the sewing machine (32). The patch pivot assembly (70) includes a pivot plate (72) that holds the garment and locker patch in a fixed, overlaid relationship and rotates in order to pivot the garment and locker patch about the sewing machine (32). The body pivot assembly (105) includes a body gripping arm (108) and body panel plate (152) that engage and hold the body portion (16) as the body pivot assembly (105) rotates about the sewing machine (32), maintaining the locker patch and garment in a fixed radial alignment as they are pivoted about the sewing machine (32). A stacker (211) automatically removes the garment from the sewing machine (32) once the locker patch has been attached thereto.

40 Claims, 8 Drawing Sheets

LOCKER PATCH ATTACHMENT SYSTEM

The present application claims priority under 35 U.S.C. §119(e)(i) to United States Provisional application Ser. No. 60/003,712 filed Sep. 8, 1995.

FIELD OF THE INVENTION

This invention generally relates to a method and apparatus for attaching a locker patch to a neck opening of a garment, such as a sweat shirt. In particular, the invention relates to a system for automatically guiding and sewing a locker patch to a garment as the garment and locker patch are advanced along an arcuate sewing path through a sewing machine.

BACKGROUND OF THE INVENTION

An increasingly popular fashionable feature on sweat shirts and other exercise or casual shirts is the application of a locker patch below the shirt collar at the back of the shirt. A locker patch is a substantially semi-circular or crescent shaped piece of cloth placed in overlying relationship with the upper back panel of a shirt and sewn to either the inside or outside surface of the rear of the garment adjacent the neckline, where a clothing tag or fabric loop typically is secured. The clothing tag which usually bears the trademark of the producer of the garment is attached to the locker patch instead of directly to the back panel of the shirt. The locker patch originally was designed to reinforce the garment so that it could be hung by its tag or fabric loop from a hook, etc. without stretching or otherwise damaging the garment. Although the locker patch was originated in order to serve this simple functional purpose, today locker patches are being used as more of a feature of style and fashion than for their function as a support for hanging the garment, typically adorning more costly clothing items.

In the conventional production of garments having locker patches applied thereto, the locker patches generally are attached to the garment by a worker who manually positions the patch about the neck opening of the garment and thereafter guides the garment, with the patch aligned thereon, about a sewing path through a sewing machine. This typically requires the worker to stretch and move around the sewing machine to move and control the movement of the garment through its sewing path while continuing to operate the sewing machine. This is a physically taxing activity that requires careful and exacting attention to maintain the locker patch in its desired alignment on the garment.

In a production line operation, such movement about the sewing machine is time consuming and makes it difficult for the worker to maintain the exact positioning of the locker patch on the garment, resulting in quality control problems and an increased potential for fatigue and on-the-job injuries. Moreover, because of the complexity of the sewing operation required to attach the locker patch to the garment, any error in guiding the garment and patch through the sewing machine can result in a damaged or missewn product that must be discarded or sold as defective. The system operator therefore is required to have relatively high skill in order to produce consistently a high quality product. Further, the operator must concentrate so completely on the sewing operation that the operator generally is prohibited from performing any additional tasks during a sewing operation, such as preparing and matching additional garment parts for sewing. As a result, the manufacture of garments with locker patches sewn thereon generally has been more expensive and has required greater production time than the production of conventional garments without locker patches. Accordingly, production of such garments has been limited and the costs of labor associated with manufacturing garments with locker patches has been prohibitively high. Consequently, such garments typically are manufactured in third world countries outside the United States where labor costs are less.

Attempts have been made to develop automated equipment that overcomes some of the inherent problems and inefficiencies with manual sewing operations, such as those discussed above. For example, U.S. Pat. No. 5,251,555 of Rohr discloses a work piece guide that attaches to a sewing machine and automatically controls the alignment of the work piece with respect to the sewing path. Additionally, U.S. Pat. No. 5,018,462 of Brocklehurst discloses an automated edge finishing system for finishing the edges of flat textile goods such as wash cloths, towels or napkins. However, neither of these two devices is designed for automatically sewing around the edge of a locker patch to attach the locker patch to the neck portion of the back panel of a shirt without requiring the constant, full attention of the operator.

Accordingly, it can be seen that a need exists for a system for automatically attaching a locker patch to a shirt that can be operated by a relatively unskilled worker and which enables the worker to perform additional functions and operations as the system sews the locker patch to the shirt to increase garment production and reduce the cost of production.

SUMMARY OF THE INVENTION

Briefly described, the present invention comprises a method and apparatus for attaching a locker patch to a shirt whereby the back panel of the shirt and the locker patch are automatically moved about the sewing needle of a sewing machine along a sewing path that substantially precisely follows the locker patch.

Typically, the garment to which the locker patch is to be connected is a knit shirt, such as a "golf shirt" or a sweat shirt, having a back panel with a neck area about which the locker patch is attached. The locker patch generally is a semi-circular shaped section of fabric for placement in overlying relationship with the upper portion of the back panel of a shirt having a neck edge for stitching adjacent the neck opening of the back panel and a longer arcuate edge about which the patch is sewn to the garment. At the start of a sewing operation of the locker patch attachment system, the locker patch is manually positioned on the garment with its neck edge aligned with the neck opening of the garment. The garment and locker patch are then manually moved into a sewing area of the sewing machine, positioned beneath the presser foot and the sewing needle of the sewing machine, with the longer arcuate edge of the locker patch positioned within the sewing path.

Laser light guides are mounted to the sewing machine about the sewing path, directed toward the sewing area. The laser light guides project optical guide lines onto the garment that serve as alignment guides for proper manual alignment of the locker patch and the garment with respect to the sewing machine. In addition, an alignment adapter is attached to the presser foot of the sewing machine for guiding the garment and locker patch into position along the sewing path. The alignment adapter includes a rear edge against which the neck area of the garment and the neck edge of the locker patch are aligned, and a channel portion which cradles the arcuate edge of the locker patch as it passes beneath the presser foot. A photocell mounted to the sewing machine further detects the proper positioning of a garment beneath the sewing machine so as to prevent accidental operation of the system when a garment is not positioned in the sewing area.

Once positioned on the sewing machine, the operator actuates a patch pivot assembly to move downwardly to clamp the work product against the bed of the sewing machine and secure the locker patch and garment in a fixed, overlaid relationship. The patch pivot assembly includes a pivot plate that is movable into engagement with the locker patch and garment. The pivot plate comprises a circularly shaped disk having an arcuate edge and includes a frictional bottom surface for engaging and holding the locker patch against the garment upon actuation by the operator. The pivot plate is pivotally mounted underneath the sewing head of the sewing machine adjacent the presser foot and sewing needle, and rotates the locker patch about the sewing path during a sewing operation. After the locker patch and garment have been properly positioned within the sewing path and the pivot plate moved into engagement with the locker patch and garment, the operator operates a switch which initiates the sewing operation.

Before the start of the sewing operation, a body pivot assembly moves automatically from the rear of the sewing machine through a horizontal arc into a position in front of the sewing machine above the body of the garment where it is lowered to engage the body of the garment. The body pivot assembly comprises a body panel plate for engaging the upper body portion of the garment adjacent the neck area of the garment where the locker patch is placed, and a body gripping arm for engaging the lower body portion of the garment adjacent the waist of the garment. Both the body pivot plate and body gripping arm are secured to a common support assembly which is rotatably mounted above the sewing machine so that the body pivot assembly can be oscillated in a horizontal arc about the sewing machine between a start or actuated position in front of the sewing machine and a finish or home position in the rear of the sewing machine. A drive mechanism is mounted above the sewing machine and is coupled to the support assembly and the body pivot assembly. The drive mechanism causes the rotation of the body pivot assembly about the sewing machine and the rotation of the pivot plate.

The body panel plate is approximately rectangularly shaped, having a frictional bottom surface for engaging the garment, and a cut-out edge portion forming an arcuate edge that is positioned adjacent the presser foot and sewing needle of the sewing machine and which moves adjacent the sewing needle as the body panel plate moves in its arcuate path about the sewing needle when the body panel plate is in its lowered, engaging position. The body panel plate is connected to the common support assembly by a support rod that is downwardly depending from the radially distant end of the common support assembly. A cylinder is mounted to the lower end of the support rod and includes a piston rod to which the body panel plate is attached. When the body panel plate and pivot plate are both lowered onto the garment, the arcuate sewing path of the sewing machine is defined by the space between the arcuate edge of the body panel plate and the arcuate edge of the pivot plate.

The body gripping arm is mounted to the common support assembly and is radially spaced outwardly from the body panel plate and is moveable with the movement of the body panel plate by the common support assembly. The body gripping arm is substantially T-shaped, having an elongated base arm extending radially outwardly from over the sewing head and a transverse arm mounted at one end of the base arm. A cylinder assembly is connected to the base arm for oscillating the body gripping arm in an upright arc about a horizontal axis into and out of engagement with the garment. Feet are mounted to the bottom surface of the transverse arm and are adapted to engage and drag the waist portion of the garment in an arcuate path about the sewing needles during a sewing operation. Once the body pivot assembly, including the body panel plate and the body gripping arm, has moved to the front of the sewing machine and the body gripping arm and body panel plate have been lowered to engage the garment, the sewing machine begins to sew the locker patch to the garment. During the sewing operation, the pivot plate, body panel plate and body gripping arm simultaneously move the garment and locker patch in an arcuate path about the sewing needles, from the front of the sewing machine to the rear of the sewing machine, following the arcuate edge of the locker patch.

The drive mechanism for the rotation of the pivot plate and body pivot assembly is mounted at the top of the sewing machine and comprises a reciprocating stepping motor and a timing belt circumscribed about its driven sheave in a driving relationship. The gear assembly includes a first gear connected to the patch pivot assembly for rotating the pivot plate and a second gear connected to the body pivot assembly for rotating the body pivot assembly. The first gear coupled to the pivot plate includes an internal clutch so the pivot plate can only be rotated in one direction by the drive mechanism. As the motor rotates the gear assembly, the body pivot assembly first is pivoted from the rear of the sewing machine to the front of the sewing machine into an initial position above the garment before the start of the sewing process, while the pivot plate which has already been lowered onto the locker patch and garment is kept from rotation by the internal clutch of its drive gear. Thereafter, the motor reverses operation at the start of sewing which causes the body pivot assembly and pivot plate to rotate about the sewing machine to move the locker patch and garment along the sewing path around the sewing machine.

After the sewing cycle, when the locker patch has been sewn to the garment, the pivot plate and body pivot assembly are disengaged from the garment and from the locker patch by their respective cylinder assemblies. A thread chain chopper is mounted to the sewing machine for severing the thread chain formed by the sewing needles and extending from the finished work product back to the sewing needles, to enable the removal of the work product once the locker patch has been attached thereto. The finished work product thereafter is removed from the sewing machine for further processing.

Therefore, it is an object of this invention to provide an automated locker patch attachment system for expediently and efficiently attaching a locker patch to a garment, such a sweat shirt.

Another object of this invention is to provide an improved method and apparatus for automatically attaching a locker patch to a garment which takes little manual effort to operate and does not require a high level of operator skill.

Another object of this invention is to provide an automated locker patch attachment system that moves a garment having a locker patch placed thereon about a sewing machine so that the arcuate edge of the locket patch moves along an arcuate sewing patch through the sewing machine.

Another object of this invention is to provide an automated locker patch attachment system having a means for aligning a garment and locker patch beneath the sewing needle of a sewing machine to ensure proper placement of the locker patch and garment for sewing.

Another object of this invention is to provide a system for automatically attaching a locker patch to a garment that enables an operator to operate the system and to perform additional functions to enable increased production of garments having locker patches attached thereto.

Further objects, features and advantages of the present invention will become apparent upon reading the following specification, when taken in conjunction with the accompanying drawings.

DETAILED DESCRIPTION

Figure 1:
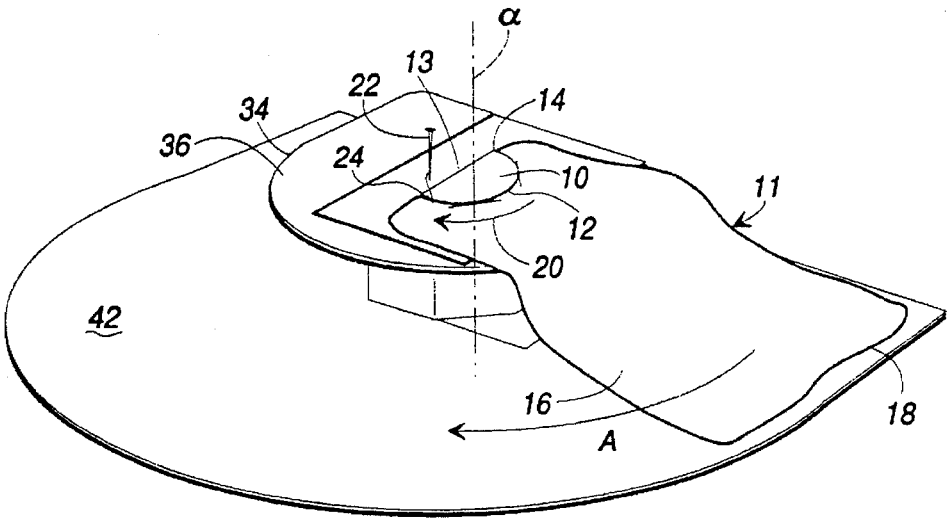
FIG. 1 is a perspective view of a partially completed gym shirt and a locker patch placed at the neck opening of the back panel of the shirt, schematically illustrating a sewing needle of the sewing machine, the upper work shelf supporting the upper portion of the shirt and the lower work table supporting the lower portion of the shirt.

Referring now in greater detail to the drawings, in which like numerals indicate like parts throughout the several views, FIG. 1 generally illustrates a locker patch 10 to be attached to a garment 11 in accordance with the present invention. The locker patch 10 generally is a substantially crescent shaped piece of fabric having an arcuate edge 12 and a neck edge 13. It will, however, be understood that the locker patch could be formed in other shapes. The garment 11 typically is a knit shirt and includes a neck area 14, a body portion 16, and a waist 18. The locker patch 10 is positioned on the garment 11 with its straight neck edge 13 positioned adjacent the neck area 14 of the garment 11. The arcuate edge 12 of locker patch 10 is moved in the direction of arrow A through a substantially arcuate sewing path 20 past sewing needles 22 during a sewing operation by the pivoting of the garment 11 and locker patch 10 about a pivot axis $\alpha$ that is displaced from the sewing needle 22. The sewing needles 22 form an overedge stitch 24 about the arcuate edge 12 of the locker patch 10 to attach and finish the arcuate edge 12 of the locker patch 10 to the garment 11.

Figure 2:
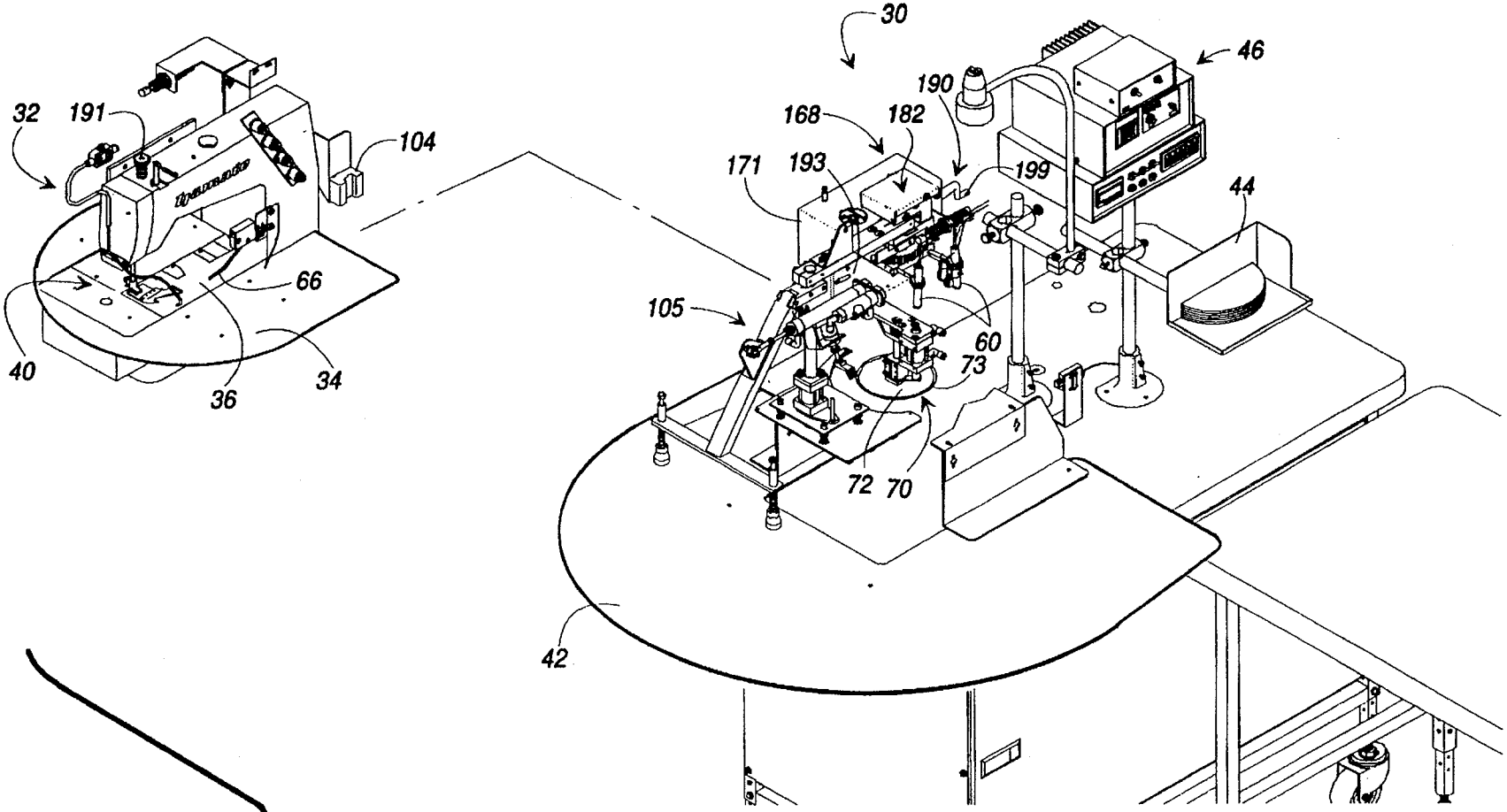
FIG. 2 is a perspective view of the locker patch attachment system showing the sewing machine displaced from the attachment system.
Figure 3:
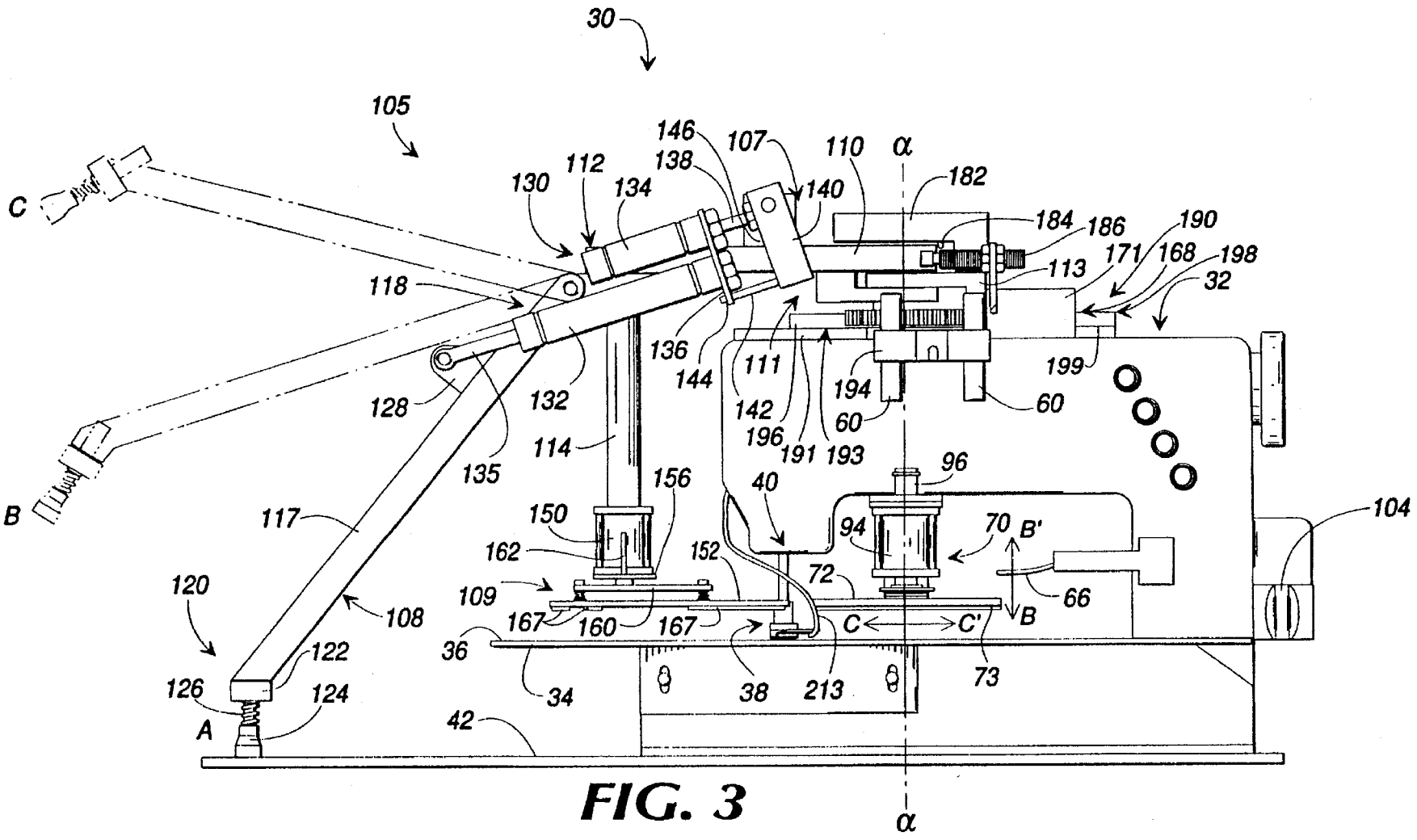
FIG. 3 is a front elevational view of the locker patch attachment system of FIG. 2, illustrating in phantom lines the various positions of the body gripping arm.

FIGS. 2 and 3 illustrate the locker patch attachment system 30 for performing the sewing and finishing functions discussed above in reference to FIG. 1. The locker patch attachment system 30 includes a sewing machine 32 mounted to a work shelf 34 having a flat upper sewing surface 36 which surrounds and is coextensive with the bed of the sewing machine. The sewing machine 32 includes sewing needles 22 (FIGS. 1 and 4) and a presser foot 38 mounted at a sewing area 40 at the sewing needles. A lower work table 42 is mounted below the sewing machine 32 and is positioned parallel to the work shelf 34 for supporting the lower portion of the garment during a sewing operation. A tray 44 (FIG. 2) is mounted adjacent the locker patch attachment system 30 for containing a supply of locker patches 10 for ready access by the operator. A programmable system controller 46 is mounted to the side of the sewing machine 32 and controls the operation of the locker patch attachment system 30 based upon inputs programmed by the operator.

Figure 4:
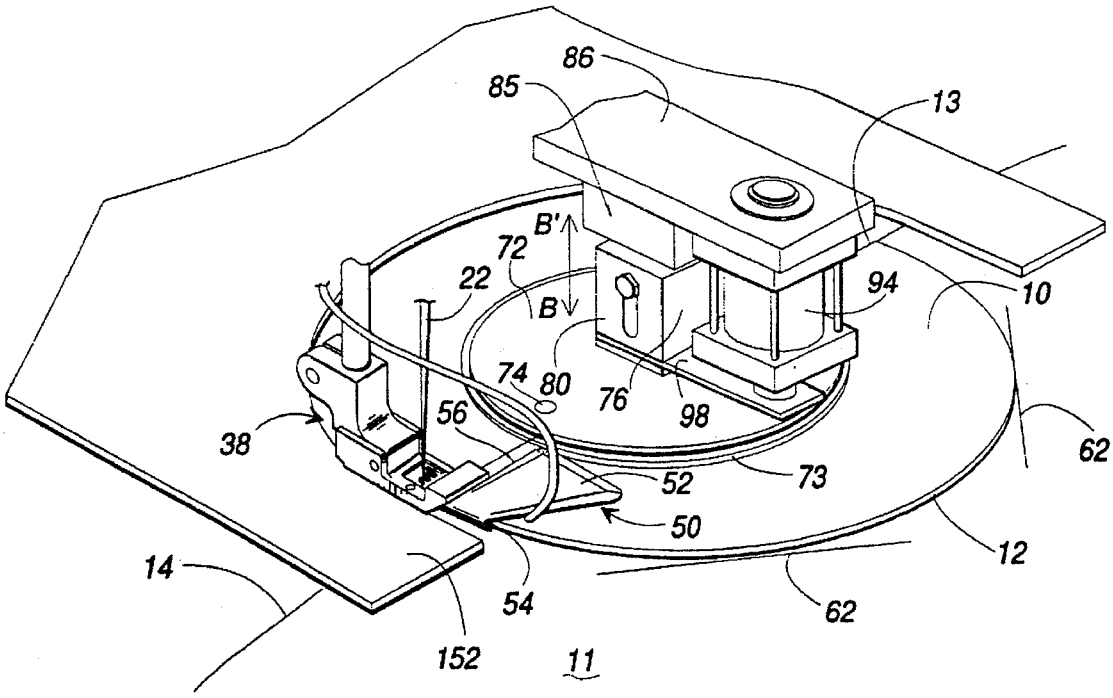
FIG. 4 is a perspective view of the presser foot and alignment adapter attached thereto for aligning the garment and locker patch.

An operator initially retrieves a locker patch 10 from the tray 44 and places and aligns the patch with respect to the neck area of the back panel of the garment 11. As shown in FIGS. 1 and 4, the locker patch 10 and the upper portion of the back panel of the garment 11 are placed on the sewing surface 36 of the work shelf 34 and received beneath the presser foot 38 of sewing machine 32 with the straight neck edge 13 of locker patch aligned with the neck line 14 of the back panel of the garment 11 prior to the start of a sewing operation. The lower body portion of the garment is draped onto the lower work table 42. An alignment adapter 50 is attached to presser foot 38 and projects forwardly therefrom. The alignment adapter engages the matched edges of the garment and locker patch as the parts are received beneath the presser foot. The alignment adapter 50 includes a horizontally extending flange 52, which projects laterally forwardly from the presser foot 38, and a guide channel 54 formed along one side of the flange 52 for cradling and guiding the arcuate edge 12 of locker patch 10 beneath the presser foot 38 and into the sewing path 20. The alignment adapter 50 further includes a straight rear edge 56 against which the straight edge 13 of locker patch 10 and the neck line 14 of garment 11 are received and aligned.

As shown in FIG. 3, light guides 60 are mounted to the sewing machine 32, and positioned above and directed toward the sewing surface 36 at the sewing area 40. Typically, the guides comprise laser light guides that project optical guide lines 62 (FIG. 4) downwardly onto the garment 11. The guide lines indicate the points where the arcuate edge of locker patch 10 is to be positioned for sewing, as shown in FIG. 4, thus functioning as a guide means for positioning the locker patch on the garment. A detector 64 (FIG. 3) is mounted adjacent the guides 60, and focused downwardly toward the sewing surface 36. The detector 64 generally comprises a photocell or similar sensor that detects the presence of the garment 11 on the sewing surface 36. If the garment is not detected, the operation of the system cannot be inadvertently actuated until the garment is properly positioned on sewing surface 36.

As shown in FIG. 3, a finger switch 66 is mounted adjacent the sewing surface 36. Finger switch 66 generally comprises a microswitch and is positioned so as to be easily actuated by the finger of the operator while the operator holds the garment and locker patch in position beneath the pressure foot. Once the garment 11 and locker patch 10 have been satisfactorily aligned by the operator in the sewing path 20 on the sewing surface using the alignment adapter 50 and light guides 60, the operator can move her hand upwardly and toggle the finger switch 66 to start the sewing operation. The actuation of the switch causes a patch pivot assembly 70 to move in the direction of arrow B toward engagement with the locker patch 10 and garment 11 so as to fix the orientation of the two pieces in an overlying relationship with respect to one another prior to the start of the pivoting operation. The position of patch pivot assembly further is adjustable in the direction of arrows C and C' to accommodate locker patches of varying sizes, generally in the range of 6 inches to 7¾ inches in diameter.

Figure 5:
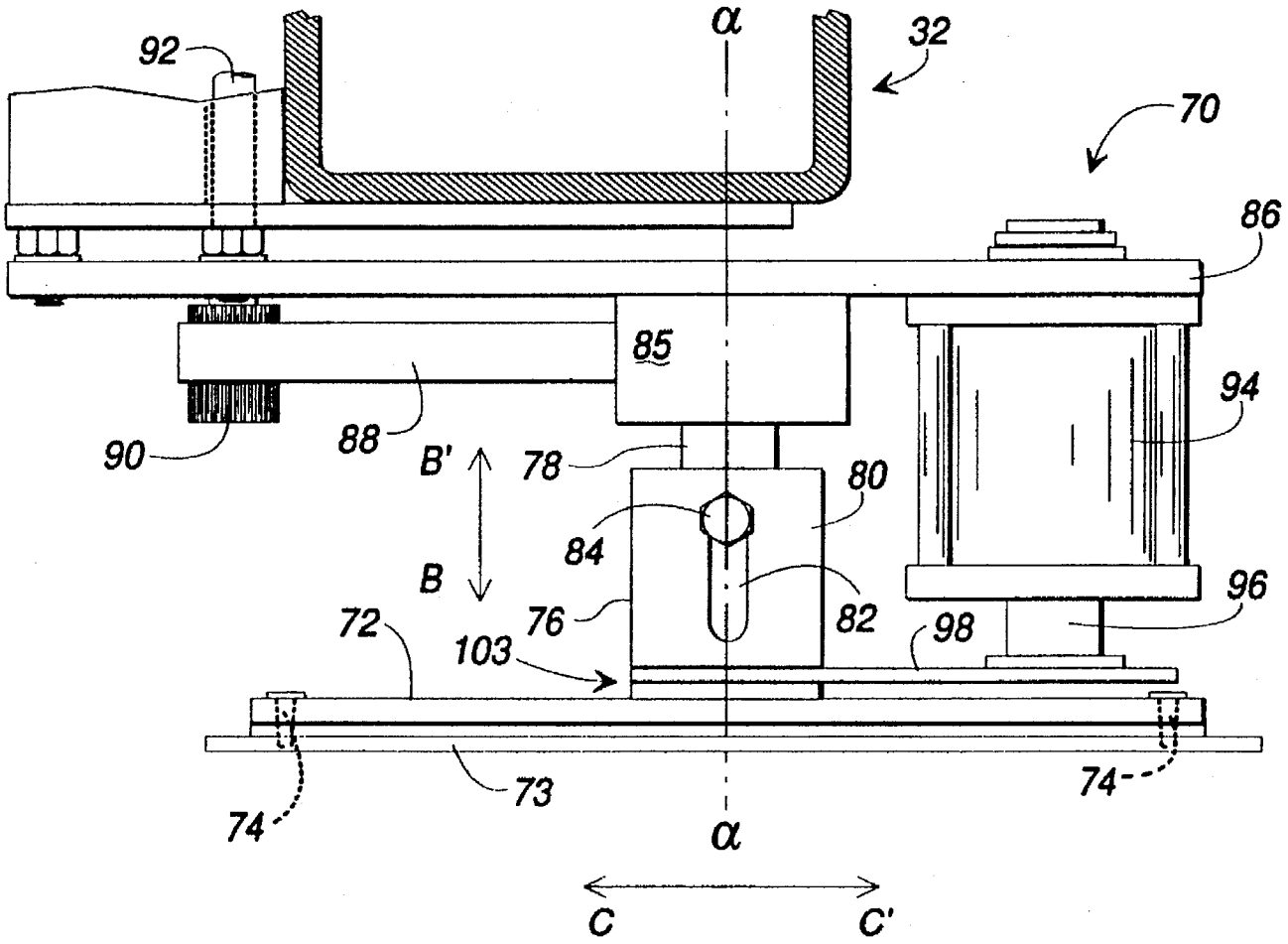
FIG. 5 is a side elevational view of the pivot plate assembly of the system of FIG. 2, illustrating the patch pivot plate in its extended position.

Referring now to FIGS. 3, 4, and 5, the patch pivot assembly 70 includes a fixed circular pivot plate 72 that is movable vertically toward and away from engagement with the locker patch 10 and garment 11 during the pivoting of the garment 11 and locker patch 10 about sewing machine. The pivot plate 72 generally is formed from metal and has a magnet (not shown) or other connector means applied to the lower surface. Interchangeable patch plates 73 are mountable to the lower surface of pivot plate 72 by the magnet and engage and grip the locker patch when the pivot plate is lowered to its engaging position. The patch plates 73 typically are formed from metal and are of varying sizes to accommodate locker patches of different sizes ranging from 6 inches to 7¾ inches in diameter. Typically, a larger patch plate is used not only for larger size locker patches, but also for locker patches of softer, flimsier material to provide greater control of the locker patch during pivoting. Locking pins 74 (FIG. 5) are inserted through the pivot plate 72 and engage lock openings (not shown) formed in the patch plates 73 applied to the pivot plate to secure the patch plates in a locked position against the pivot plate during pivoting of the locker patch and garment to prevent slippage.

The pivot plate 72 is rigidly secured to the lower end of a support sleeve 76. The sleeve 76 is substantially rectangular and includes a central cavity (not shown) open to one side. A pivot shaft is slidably received within the central cavity of the sleeve. A rectangularly shaped plate 80 having a vertically extending slot 82 formed therein is secured to the sleeve 76, positioned over the open side thereof to slidably retain the lower end of pivot shaft 78 within the sleeve. A shoulder pin 84 extends through the slot 82 and is screwed into pivot shaft 78. The shoulder pin slides along the slot 82 to enable vertical movement of sleeve 76 and pivot plate 72 with respect to pivot shaft 78 and secures the sleeve and pivot plate to the pivot shaft so that the pivot plate is caused to rotate with the pivot shaft 78.

Figure 6:
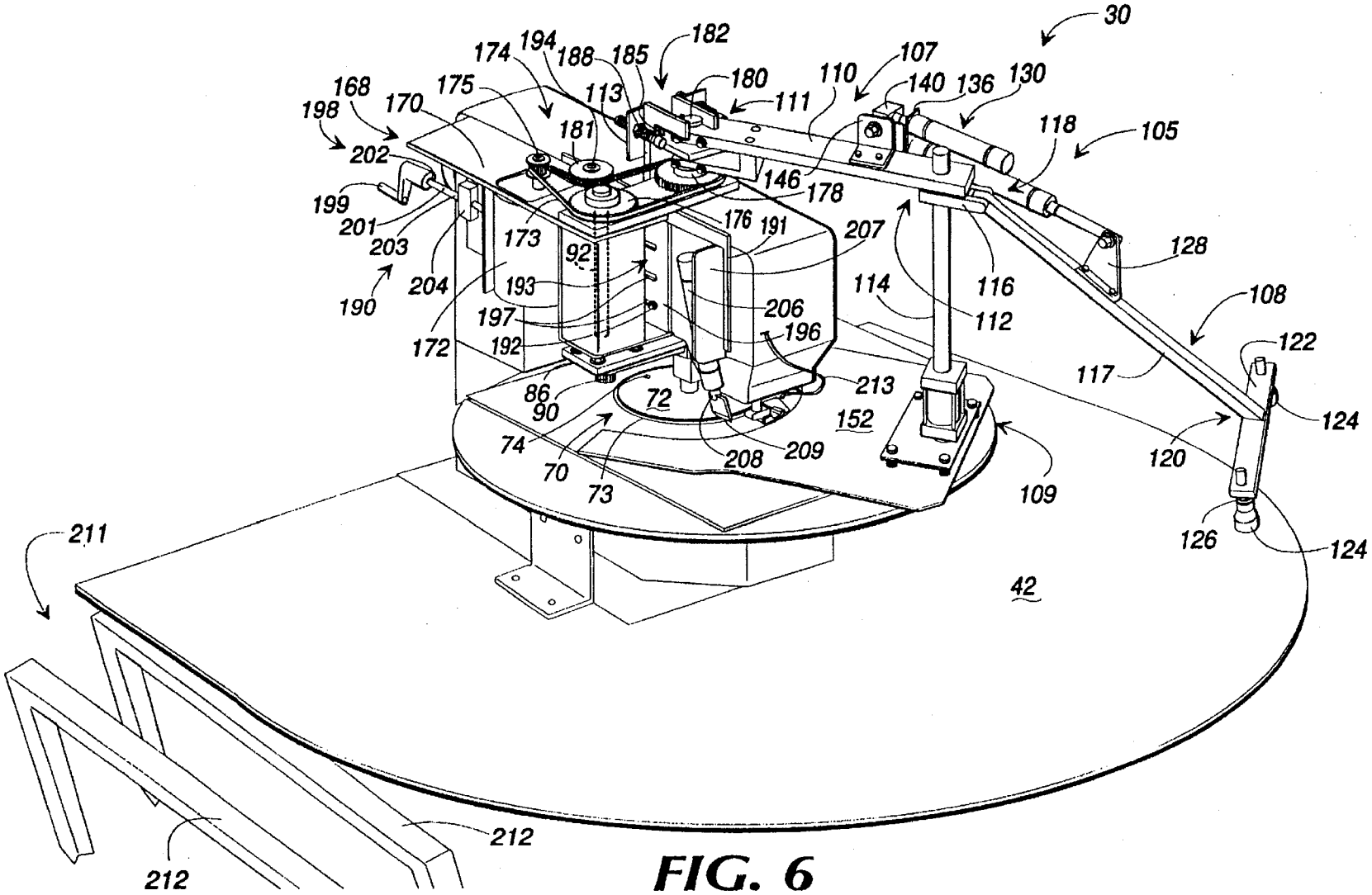
FIG. 6 is a perspective view of the system of FIG. 2 taken from the rear thereof with the rear cover removed to show the drive mechanism.

The upper end of the pivot shaft 78 is rotatably received in a support bracket 85. The support bracket is mounted to a support arm 86 that is secured to sewing machine 32 and extends from the rear of sewing machine to the front of sewing machine above the sewing surface 36. A gear means (not shown) is secured to the upper end of pivot shaft 78 within bracket 85 and is engaged by a ribbed drive belt 88, which extends about an additional gear 90 that is mounted to the lower end of a drive shaft 92. As shown in FIG. 6, drive shaft 92 extends upwardly adjacent the sewing machine. The drive shaft is coupled to and is driven by a drive mechanism 168 as discussed in greater detail below. The rotation of the drive shaft 92 drives pivot shaft 78, with shoulder pin 84 engaging sleeve 76 so as to rotate sleeve 76 and pivot plate 70 with the pivot shaft 78.

As further illustrated in FIGS. 3, 4 and 5, a pneumatic cylinder 94 is mounted above the pivot plate 72, positioned in front of the pivot shaft 78. The cylinder 94 is mounted to and supported above the pivot plate by support arm 86 in the front of sewing machine 32. Cylinder 94 (FIG. 5) generally includes a piston 96 that is moveable vertically, and is actuated upon engagement of the finger switch 66. A follower bar 98 is mounted to the lower end of piston 96 and includes a slotted end (not shown) that engages and couples to the sleeve 76 at a groove 103 formed at the lower end of the sleeve adjacent the pivot plate 72, as illustrated in FIG. 5. The follower bar moves the sleeve 76, and thus the pivot plate, into and out of engagement with the locker patch and garment with the actuation of piston 94. In response, the cylinder extends piston 96 which lowers follower bar 98, causing the pivot plate 72 to engage the garment 11 and locker patch 10.

As shown in FIGS. 2 and 3, a start switch 104 is mounted adjacent the sewing machine 32. The start switch generally is a thumb swipe switch actuated by the movement of a finger of the operator thereover. Once the operator is satisfied with the alignment of the garment and locker patch, the operator passes her thumb along the thumb swipe switch 104 to start the sewing operation. The actuation of the switch 104 causes the movement of a body pivot assembly 105 into engagement with the garment and the commencement of the sewing of the garment parts.

Figure 7:
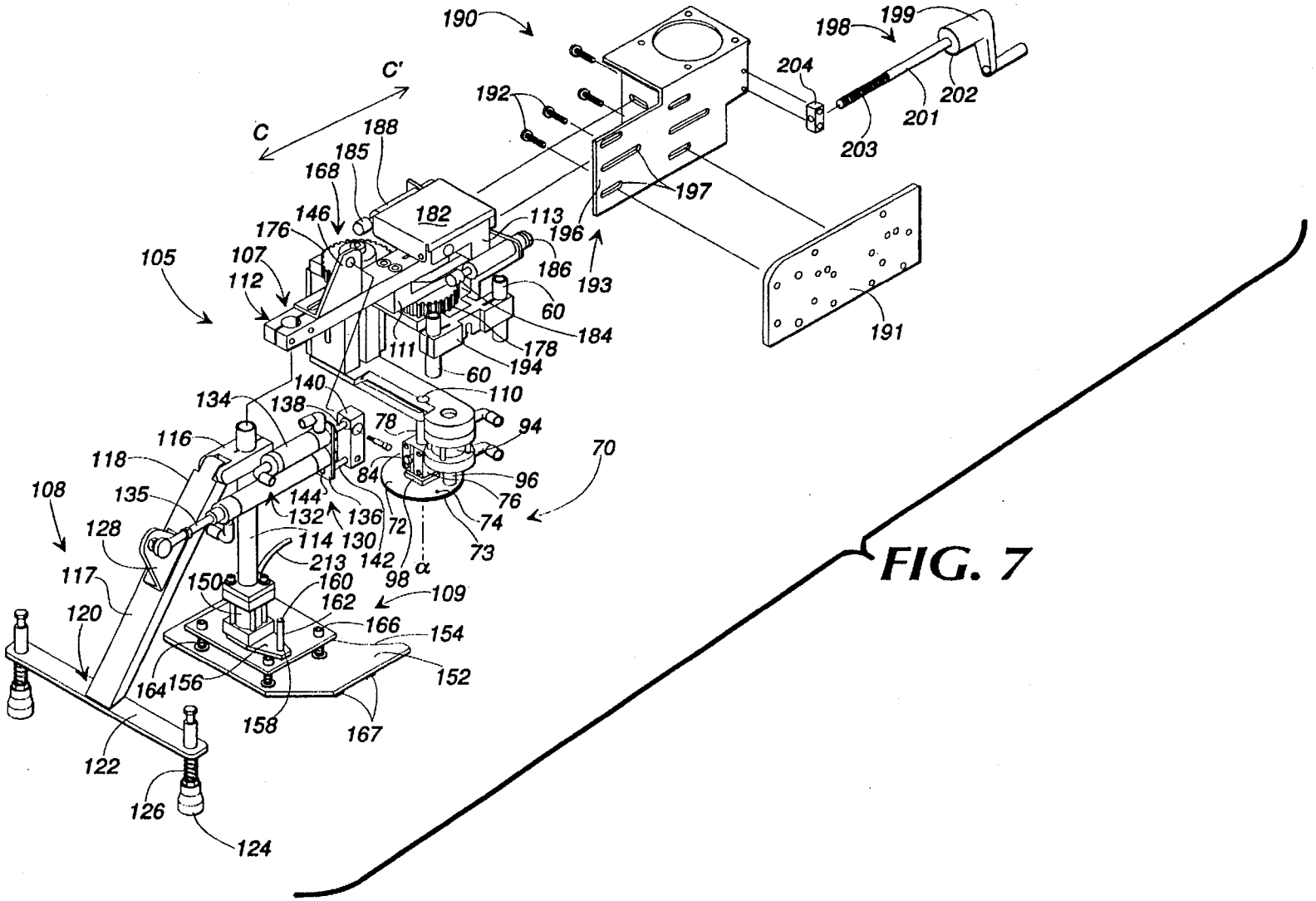
FIG. 7 is a perspective view of the body pivot assembly of the locker patch attachment system of FIG. 2.

As illustrated in FIGS. 3, 6 and 7, the body pivot assembly 105 includes a support assembly 107, a pivot arm assembly 108 and a body panel plate assembly 109. The support assembly includes a horizontally oriented support arm 110 that is mounted to the drive mechanism 168, positioned above the sewing machine 32 (FIGS. 3 and 6) and extending radially outwardly. The support arm 110 generally is a substantially rectangularly shaped bar or beam having a substantially U-shaped first end 111 positioned above the sewing machine, and a second end 112 that projects radially outwardly away from the sewing machine. The U-shaped first end 111 of the support arm is pivotally attached to a substantially F-shaped support bracket 113 mounted to the top of the sewing machine so that the support arm is spaced above the sewing machine and rotatable about the same pivot axis $\alpha$ as the patch pivot assembly 70 (FIG. 3). As illustrated in FIG. 7, a support rod 114 is mounted to and extends downwardly from the second end 112 of the support arm 110. The pivot arm assembly 108 is pivotally mounted to the support rod 114 adjacent the second end 112 of the support arm 110 by a support bracket 116 mounted about the upper end of the support rod.

As illustrated in FIG. 7, the pivot arm assembly 108 includes a base portion 117, which generally comprises an elongated bar or beam having a first end 118 that is pivotally mounted to the support bracket 116 and a second end 120 spaced therefrom. The pivot arm assembly thus is moveable, as illustrated in FIG. 3, about a substantially arcuate path in a swing or pivoting motion about its first end 118, moving from a raised non-engaging position to intermediate and lowered engaging positions. A transverse support arm 122 is mounted to the second end 120 of the base portion, giving the pivot arm assembly a substantially T-shaped appearance. Feet 124 are mounted at the opposite ends of the transverse support arm 122. The stoppers generally are formed from rubber or a similar type of non-skid cushioning means that will engage and hold the body of the garment against the work table 42 (FIG. 6) so as to move the waist of the garment over the work table during a sewing operation without tearing or otherwise damaging the fabric of the garment. Compression springs 126 are mounted between the feet and the transverse support arm 122 and are intended to bias the feet downwardly into engagement with the garment and provide a means for and act as a shock absorbing means for the stoppers.

As FIGS. 3 and 7 illustrate, a cylinder bracket 128 is mounted to the base portion 117 of the pivot arm assembly, intermediate the first and second ends 118 and 120 thereof. The cylinder bracket 128 pivotally connects the pivot arm assembly 108 to an arm actuating assembly 130. Arm actuating assembly 130 comprises a first cylinder 132 and second cylinder 134. First cylinder 132 is pivotally connected via a piston 135 to the cylinder bracket 128 and is rigidly secured at the opposite end to linkage plate 136. Also mounted to linkage plate 136 is second cylinder 134 so that cylinders 132 and 134 are secured in fixed relation to respect one another, as shown in FIGS. 3 and 7. Second cylinder 134 also includes a piston 138 that is rigidly connected to a support block 140. A guide rod 142 is attached to the support block 140 and extends through an aperture 144 in linkage plate 136 for maintaining cylinders 132 and 134 in a proper over-under orientation with respect to support block 140. The support block 140 is pivotally attached to a cylinder bracket 146 which is mounted to the top of support arm 110 intermediate ends 111 and 112 thereof. Thus, by selectively actuating first and second cylinders 132, 134, body gripping arm 116 can place in any one of several possible positions, as illustrated in FIG. 3.

For purposes of the preferred embodiment, the following three positions for body gripping arm 116 are utilized. First, by extending both first and second cylinders 132, 134, pivot arm assembly 108 is at a low position, denoted as A in FIG. 3, so that feet 124 are urged against work table 42. Secondly, by extending first cylinder 132 and retracting second cylinder 134, pivot arm assembly 108 is at a middle position, denoted as B in FIG. 3, so that feet 124 are spaced slightly above work table 42. Lastly, by retracting both first and second cylinders 132, 134, pivot arm assembly 108 is at a high position, denoted as C in FIG. 3, so that stoppers 124 are spaced far above work table 42. The functionality of positions A, B and C is discussed in detail below with regard to the operation of system 30.

The body panel plate assembly 109 is mounted to the lower portion of support rod 114 which is rigidly mounted to and depends downwardly from the second end 112 of support arm 110. The body panel plate assembly 109 comprises a panel plate cylinder 150 having a vertically extendable piston rod therein for raising and lowering a body panel plate 152. The body panel plate is as substantially rectangularly shaped plate having a cut-out portion forming an arcuate edge 154. The arcuate edge is positioned adjacent the presser foot 38 and sewing needles 22 of the sewing machine 32. The space between the arcuate edge 154 of body panel plate 152 and circular edge of pivot plate 72 defines the sewing path 20 through which sewing needle 22 and presser foot 38 travel, as generally shown in FIGS. 6 and 8A–8C.

To prevent body panel plate 152 from rotating with respect to support rod 114, a guide plate 156 having an aperture 158 therethrough is rigidly mounted to the bottom of cylinder 150. A mounting plate 160, to which the body panel plate 152 is mounted, is rigidly secured to the bottom of the piston rod of cylinder 150 so as to be positioned beneath and substantially parallel to guide plate 156. An upwardly extending guide rod 162 is attached to the top of mounting plate 160 so that guide rod 162 extends upwardly through the aperture 158 in guide plate 156 so as to maintain mounting plate 160, and thus body panel plate 154, aligned with respect to support assembly 107 as the body panel plate is vertically actuated by cylinder 150.

The body panel plate 152 is mounted to the bottom of mounting plate 160 in a spring loaded configuration so as to allow angular displacement of body panel plate 152 with respect to mounting plate 160. In the preferred embodiment, this is accomplished by placing a spring 164 about each respective pin 166 connecting body panel plate 152 to mounting plate 160. Rubber strips 167 are mounted to the underneath surface of body panel plate 152 for providing frictional contact between body panel plate 152 and garment 11 to enable the body panel plate to move the garment over work shelf 42.

As shown in FIG. 6, drive mechanism 168 is mounted above and to the rear of sewing machine 32, supported by a mounting bracket 170 and a F-shaped bracket 113. A drive mechanism cover 171 (FIGS. 2 and 3) generally covers the drive mechanism 168 to protect drive mechanism 168 and prevent possible injury to the operator. Drive mechanism 168 includes a reciprocating stepping motor 172 that drives a ribbed drive belt 173 which is circumscribed about a gear assembly 174 in a driving relationship. The gear assembly 174 includes a toothed drive gear 175 mounted to the drive shaft of stepping motor 172. Drive belt 173 further wraps around a second toothed drive gear 176 which is coupled to drive shaft 92 for rotating patch pivot assembly 70. Incorporated in second drive gear 176 is an internal clutch mechanism so that drive shaft 92 is only rotated in one direction, in the preferred embodiment clockwise, by drive belt 173 and remains idle when drive belt 173 rotates in the opposite direction.

In addition, the gear assembly 174 includes a third toothed drive gear 178 which drives an axle 180 that is coaxial with pivot shaft 78 of patch pilot assembly 70 and to which support arm 110 is rigidly attached. Consequently, as drive belt 173 rotates third drive gear 178, body pivot assembly 107 is likewise rotated about sewing machine 32. An idler wheel 181 is provided to tension drive belt 173 in order that the teeth of drive gears 175, 176 and 178 adequately mate with the ribs of drive belt 173 during the operation of system 30.

A housing 182 is mounted to the top F-shaped bracket 113 substantially above U-shaped end 111 of support assembly 107. The housing 182 is usually covered, as shown in FIGS. 2 and 3, but is shown uncovered in FIG. 6 in order to reveal the interior thereof. A front limit switch 184 (FIG. 3) is mounted inside the housing 182 for indicating when support arm 110 of the body pivot assembly 105 is in a front starting or activated position. A rear limit switch 185 is also mounted inside housing 182 for indicating when support arm 110 of the body pivot assembly 105 is in a rear or home position. A front shock absorber 186 (FIG. 3) is mounted to the front of sewing machine 32 above light guides 60 and a rear shock absorber 188 is mounted to the rear of sewing machine 32 above drive mechanism 168. The shock absorbers 186, 188 are provided at the front and rear of sewing machine 32, respectively, in order to engage support arm 110 to absorb the mechanical energy (i.e., momentum) of body pivot assembly 105 as it is rotated about sewing machine 32 to an extreme position where it preferably will stop in an abrupt fashion.

As shown in FIG. 7, a means 190 for moving the patch pivot assembly laterally in the direction of arrows C and C', across the sewing patch is provided at the rear of the patch pivot assembly 70 and body panel pivot assembly 105. The means 190 for moving the patch pivot assembly generally includes a mounting plate 191 that is affixed to the housing of the sewing machine 32 (FIG. 2) along a rear side surface thereof by fasteners 192 such as bolts or screws. The mounting plate 191 (FIG. 7) generally is a substantially rectangularly shaped metal plate that extends along an intermediate portion of the length of the sewing machine. A sliding plate assembly 193 is attached to the mounting plate 191 by the fasteners 192, with the patch pivot and body panel pivot assemblies being mounted to and supported by the sliding plate assembly so as to be movable therewith. As FIG. 7 shows, the patch pivot and body panel pivot assemblies are mounted to a support bracket 194, which supports the drive mechanism 168 for the patch pivot and body panel pivot assemblies, patch pivot assembly 70, body panel pivot assembly 105 and light guides 60, and which is mounted to the sliding pad assembly to thus attach the pivot assemblies, drive mechanism and guides thereto.

The sliding plate assembly 193 includes a vertical slide plate 196 that mounts to the mounting plate 191 and has a series of mounting slots 197 through which the fasteners 192 are received. The slots enable the slide plate to slide along the mounting plate in the direction of arrows C and C'. A crank member 198 is provided at the rear of the sliding plate assembly 193, mounted to the housing of the sewing machine, for moving the sliding plate assembly laterally in the direction of arrows C and C'. The crank member includes a handle 199, a travel rod 201 having a first end 202 to which the handle 199 attaches and a threaded second or opposite end 203 that engages a mounting block 204 attached to the slide plate 196. As the handle is rotated, the threaded end 203 of the travel rod 201 screws into and out of its mounting block 204 to push or pull the sliding plate assembly in the direction of arrows C and C'. The position of the pivot plate 72 (FIG. 4) thus can be adjusted with respect to the sewing needle and presser foot to accommodate the sewing of varying size locker patches.

In addition, as shown in FIG. 6, a pneumatically actuated thread chain chopper 206 is mounted at an angle to sewing machine 32 via a mounting bracket 207. The chopper 206 includes an extensible piston 208 having a cutting edge 209 secured to its distal end. Chopper 206 is configured downstream of presser foot 38 with reference to the sewing path 20 so that it can be actuated as the garment 11 is being removed from sewing machine 32 by a stacker 211 in order to sever, with cutting edge 209, the thread used to sew locker patch 10 to the garment 11. The stacker 211 is positioned at the rear of the system 30, substantially below work table 42 and comprises a pair of stacker arms 212 that are normally separated. The stacker arms 212 come together to engage and pull the finished garments from the locker patch attachment system upon completion of a sewing cycle, with the garments stacked on top of one another for removal and further processing. An air supply tube 213 further is provided adjacent the sewing machine, at the presser foot 38 thereof. The air supply tube supplies a directed burst of air beneath presser foot 38 to urge garment 11 out from underneath presser foot 38 to assist in the removal of garment 11 from underneath presser foot 38 once locker patch has been completely attached and stacker is removing garment 11.

Operation

Figure 8A:
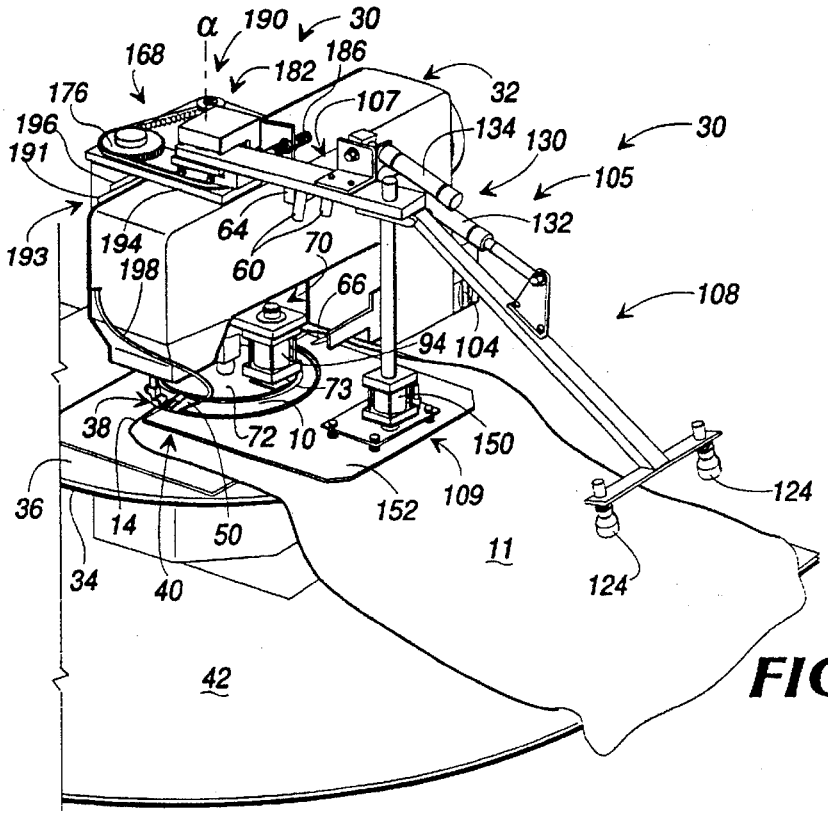
FIGS. 8A–8C are schematic views of the system of FIG. 2 illustrating the method of attaching a locker patch to a garment.
Figure 8B:
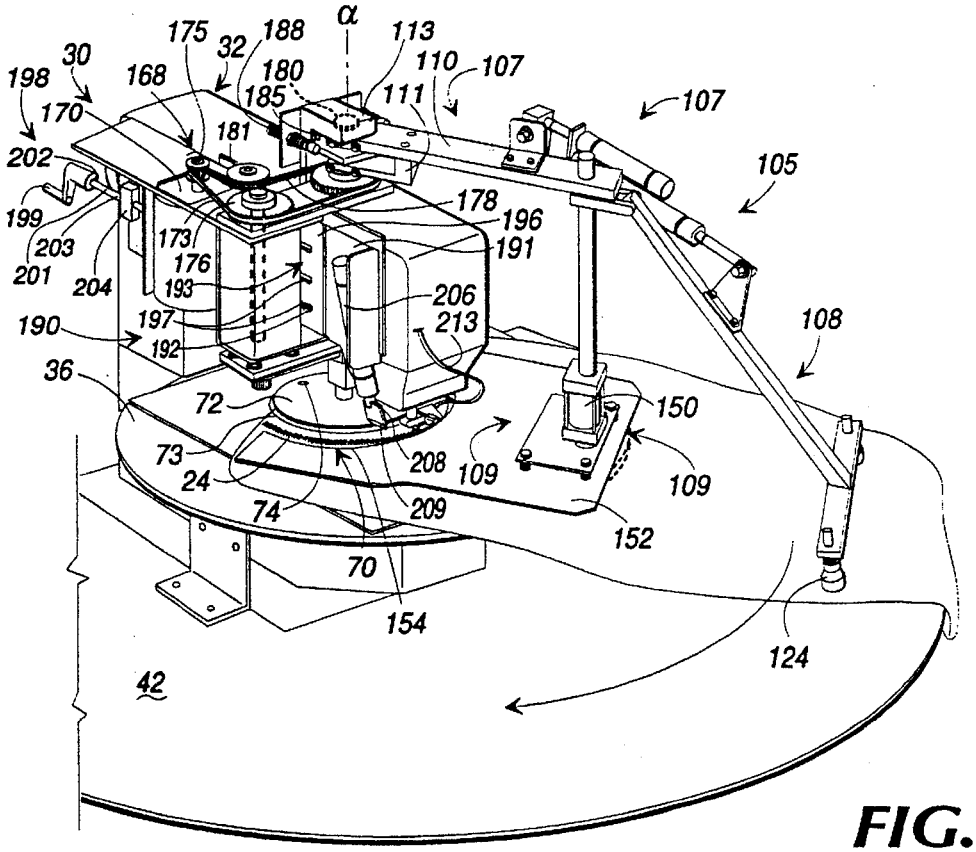

The operation of locker patch attachment system 30 is explained hereinafter with particular reference to FIGS. 8A–8C which schematically illustrate the various steps of a method for attaching locker patch 10 to garment 11 in accordance with the present invention.

Prior to the commencement of a sewing operation by the locker patch attachment system 30, the operator adjusts the position of the patch pivot assembly 70 with respect to the sewing needles 22 (FIG. 4) and presser foot 38, and adjusts the direction and focus of the light guides, and thus the optical guideline 62 provided by the light guides 60, according to the size of the locker patch to be attached to the garment. The locker patch attachment system is designed to accommodate the sewing of locker patches of a diameter or size of approximately 6 inches to 7¾ inches. The position of the pivot plate 72 of the patch pivot assembly 70 is adjusted laterally in the direction of arrows C and C' (FIG. 7) with respect to the sewing needle and presser foot by the rotation of the handle 199 of the crank member 198. As the handle is rotated, the threaded end 203 of the travel rod 201 engages and screws into and/or out of a mounting block 204 mounted to the slide plate 196 of the sliding plate assembly 193. The slide plate 196 accordingly is pulled or urged in the direction of arrows C or C', with the mounting slots 197 of the slide plate sliding along the fasteners received therethrough. As a result, the drive mechanism 168, patch pivot assembly 70, body panel pivot assembly 105 and light guides 60 are moved in the direction of arrows C or C' to adjust their position with respect to the locker patch and garment.

For sewing smaller sized locker patches of approximately 6 inches, the pivot plate generally is moved to a position closest to the presser foot and sewing needle, and a small diameter patch plate 73 having a diameter substantially equivalent to that of the pivot plate is applied thereto. For sewing larger locker patches, and for locker patches formed softer, flimsier material, the pivot plate generally is moved in the direction of arrow C' (FIG. 5) to a position spaced from the sewing needle and presser foot, and a larger diameter patch plate 73 is applied to the pivot plate. The larger diameter patch plate provides increased control and stability for locker patches made from flimsier, softer material and for larger sized locker patches during a pivoting and sewing operation. Once the patch pivot assembly has been adjusted to the proper position for accommodating a locker patch of a desired size, the operator thereafter adjusts the direction and focus of the light guides 60 (FIG. 8A) to adjust the position of the optical guidelines generated by the light guides to the proper position required to align the edges of the locker patch with the sewing path for sewing.

Once the operative elements of the locker patch attachment system have been adjusted to their proper sewing positions, the operator places a locker patch 10 on a garment 11 with the straight edge 13 of locker patch 10 aligned with the neck line 14 of the garment 11, as generally illustrated in FIGS. 1 and 4. The garment 11 and locker patch 10 then are moved into the sewing area 40, positioned beneath the presser foot and sewing needle of the sewing machine and the patch pivot assembly 70. The garment and locker patch are aligned with the sewing path by aligning the arcuate edge 12 of the locker patch 10 with optical guide lines 62 produced by light guides 60 and the receipt and engagement of the arcuate edge 12 of locker patch 10 into a channel 54 of a presser foot alignment adapter 50, and the straight neck edge 13 of locker patch 10 with the straight rear edge 56 of the adapter 50, as illustrated in FIGS. 4 and 8A.

Once garment 11 and locker patch 10 have been positioned properly, a finger switch 66 is toggled by the operator. In response, cylinder 94 is actuated and extends its piston 96 downwardly to causing pivot plate 72 of patch pivot assembly 70 to be lowered into engagement with the locker patch 10 and garment 11 so as to secure them in a fixed overlaid relationship with respect to one another. The pivot plate 72, however, is lowered into engagement with the garment only if photocell 64 detects the presence of a garment 11 on sewing surface 36. Additionally, the presser foot 38 and sewing needles 22 are lowered into a sewing position when finger switch 66 is toggled. By toggling finger switch 66 a second time, cylinder 94 retracts piston 96, raising pivot plate 72. This allows the operator to realign the locker patch and garment if needed, after which another toggle of finger switch 66 lowers pivot plate 72 back into engagement with the locker patch and garment.

Once the operator is satisfied with the position and alignment of garment 11 and locker patch 10 with respect to sewing machine 32, the operator passes their thumb through a thumb swipe switch 104 to actuate the sewing operation of the locker patch attachment system 30. Prior to actuating thumb swipe switch 104, a body pivot assembly 105 is at its home position to the rear of sewing machine 32, thus allowing the operator access to the front of sewing machine 32 for positioning and aligning garment 11 and locker patch 10 beneath pivot plate 72. Upon actuation of switch 104, a drive mechanism 168 moves the body pivot assembly 105 from its home position at the rear of sewing machine 32 to its starting or activated position in the front of the sewing machine 32. As the body pivot assembly is rotated, the pivot arm assembly 108 thereof is kept at its middle resting position B, out of engagement with the garment. Because of an internal clutch in drive gear 176 of the drive mechanism 168, patch pivot plate 72 does not rotate as body pivot assembly 105 is moved about sewing machine 32 by drive mechanism 168 so that the positioning of garment 11 and locker patch 10 beneath pivot plate 72 is not disturbed.

As the body pivot assembly 105 is rotated into its activated position at the front of sewing machine 32, support arm 110 engages and actuates a front limit switch 184 mounted in housing 182. This signals stepping motor 172 of drive mechanism 168 to stop, thereby halting movement of body pivot assembly 105. Upon actuation of the front limit switch 184 by the body pivot assembly, a body panel plate 152 is lowered from its middle position B (FIG. 3) into engagement with body portion 16 of the garment 11 by the actuation of panel plate cylinder 150. The pivot arm assembly 108 is pivoted simultaneously toward engagement with the waist of the garment, with the waist engaged between the feet 124 of the pivot arm assembly and the work table 42, by the actuation of first and second cylinders 132, 134 of arm actuating assembly 130.

Once body pivot assembly 105 has engaged the garment 11, the sewing machine 32 begins sewing. As indicated in FIG. 8B, the sewing machine sews about the arcuate edge of the locker patch about the neck area of the garment, as the drive mechanism 168 rotates the body pivot assembly 105 and patch pivot assembly 70 about pivot axis $\alpha$. This causes the garment 11 and locker patch 10 to be moved in an arcuate sewing path 20 defined by the arcuate edge of the pivot plate 72 and the arcuate edge 154 of body panel plate 152, following along the arcuate edge 12 of locker patch 10. The body pivot assembly 105 and patch pivot assembly 70 are rotated in conjunction about the same pivot axis $\alpha$ and at substantially the same angular velocity. As a result, the body portion 16 of garment 11 remains in radial alignment with the locker patch 10 and the upper section of body portion 16. Rubber strips 167 applied to the bottom of body panel plate 152 and a frictional gripping pad 74 on the bottom of pivot plate 72 function to hold the upper body portion of garment 11 against work shelf 34 so as to move the body of garment 11 over work shelf 34. In a like manner, feet 124 of body gripping arm 108 hold the body of the garment against the work table 42 so as to move the waist of garment 11 over the work table 42 with the rotation of the body gripping arm.

Figure 8C:
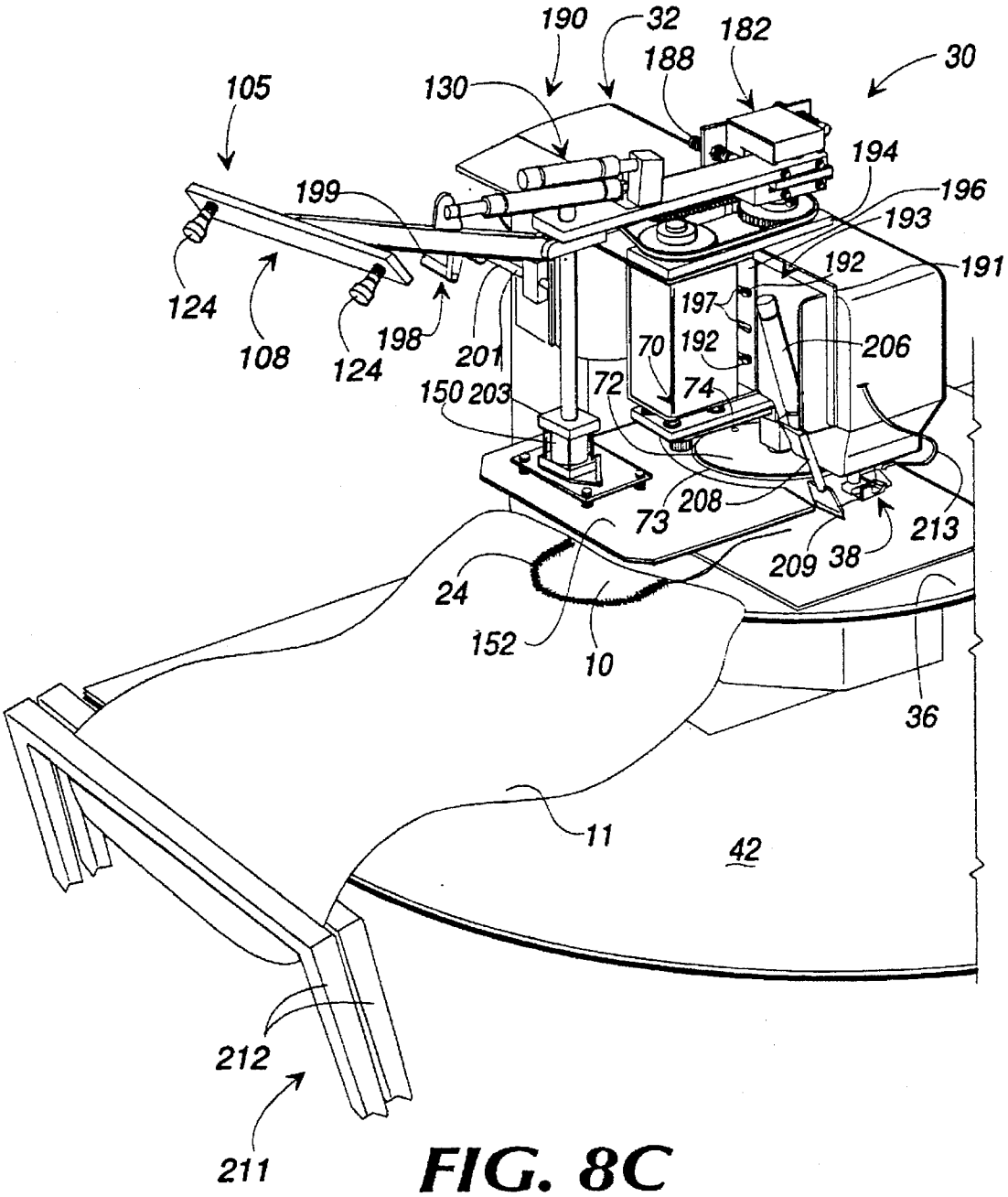

The body pivot assembly 105 and patch pivot assembly 70 rotate the garment 11 and locker patch 10 approximately 180° about the sewing machine 32 to the home position of the body pivot assembly 105 at the rear of sewing machine 32, as illustrated in FIG. 8C. As body pivot assembly 105 reaches its home position, support arm 110 engages and actuates a rear limit switch 185 in housing 182, signaling the stepping motor 172 of the drive mechanism 168 to halt the motion of body pivot assembly 105 and patch pivot assembly 70.

The actuation of limit switch 185 also triggers the removal of garment 11 from sewing machine 32. In order to remove garment 11, body gripping arm 108 is raised to its highest position C (FIG. 3) by the retraction of first and second cylinders 132, 134 of arm actuating assembly 130. As body pivot assembly 105 disengages garment 11, the stacker arms 212 of the stacker 211 grab hold of the lower section of body portion 16 of garment 11 and pull the garment out from underneath presser foot 38 and away from sewing machine 32 (as shown in FIG. 8C). This action is assisted by a directed burst of air emitted from air supply tube 213.

As garment 11 is being removed, sewing machine 32 continues to form stitches to form a stitch chain extending from the garment 11. As the garment is being pulled from the sewing machine by stacker or similar removal means, the chopper 206 is actuated to sever the stitch chain. This frees garment 11 from sewing machine 32 and allows garment 11 to be removed for further processing at another work station.

While locker patch 10 is being attached to garment 11, the operator is able to retrieve a next garment 11 and align a locker patch 10 thereon. The present invention thus enables the operator to prepare additional garment puts for sewing or operate multiple machines simultaneously. Additionally, the operator is not required to have an extremely high degree of skill to operate the present invention. Thus, the present invention enables the fast and efficient production of garments with locker patches to enable increased production while reducing production costs. Accordingly, the process described hereinabove is then repeated in a continuous manner, producing a high quality textile product in an efficient and expedient manner.

It will be understood that the foregoing relates only to the preferred embodiment of the present invention, and numerous changes and modifications may be made therein without departing from the spirit and scope of the invention as set forth in the following claims.

Wherefore, the following is claimed:

1. A system for attaching a locker patch having an arcuate edge to a garment by sewing about said arcuate edge of said locker patch, comprising:

a sewing machine having a presser foot and at least one sewing needle for forming stitches in the locker patch and garment;

locker patch pivot means mounted adjacent said sewing machine for securing the locker patch and the garment together in a fixed, overlaid relationship and for pivoting the locker patch and garment about an axis displaced from the needle so that an edge of the locker patch is passed adjacent and is engaged and sewn by the sewing needle as the locker patch and garment are moved along a substantially arcuate sewing path; and garment pivot means positioned adjacent said sewing machine and displaced from said locker patch pivot means for gripping and moving the garment in conjunction with the movement of the locker patch by said locker patch pivot means as the locker patch and garment are moved along said sewing path by said locker patch pivot means and the locker patch is sewn to the garment by the sewing machine.

2. The system of claim 1 and further comprising drive means for substantially simultaneously driving said patch pivot means and said garment pivot means in combination.

3. The system of claim 1 and further comprising means for aligning the locker patch and the garment in an initial sewing position with respect to said sewing needle prior to actuating the locker patch attachment system.

4. The system of claim 3 and wherein said means for aligning includes light guides that project optical guides on the garment for aligning the locker patch on the garment with respect to said sewing needle.

5. The system of claim 3 and wherein said means for aligning includes an alignment flange attached to said presser foot of said sewing machine and having a first edge with which the garment is aligned and an alignment channel adapted to receive an edge of the locker patch therein for positioning the edge of the locker patch along the sewing path in alignment with said sewing needle prior to starting a sewing operation.

6. The system of claim 1 and wherein said locker patch pivot means comprises a fixed pivot plate movable toward engagement with the locker patch and garment and connected to a drive means for rotating said pivot plate and thus the locker patch and garment about the sewing path, and a removable patch plate adapted to attach to said fixed pivot plate for engaging and holding the locker patch as the locker patch is moved along the sewing path.

7. The system of claim 1 and wherein said sewing machine includes a top shelf surrounding said sewing machine, and said garment pivot means comprises a panel plate for acting upon a body portion of said garment overlying said top shelf.

8. The system of claim 7 and wherein said sewing machine further includes a bottom shelf surrounding said sewing machine and vertically displaced below said top shelf, and said garment pivot means further comprising a body gripping arm adapted to engage and support the waist portion of said garment overlying said bottom shelf during a sewing operation.

9. The system of claim 1 and further including a means for adjusting the position of said locker patch pivot means relative to the presser foot and the sewing needle to accommodate locker patches of varying sizes.

10. The system of claim 9 and wherein said means for adjusting the position of said locker patch pivot means comprises a sliding plate assembly to which said locker patch pivot means is mounted, said sliding plate assembly being movable laterally with respect to the sewing needle, and a crank member for moving said sliding plate assembly.

11. A system for automatically attaching a locker patch having an arcuate edge to a garment by sewing about the arcuate edge of the locker patch as the locker patch and the garment are moved along a substantially arcuate sewing path with respect to a sewing needle of a sewing machine, comprising:

a sewing platform including a work surface extending about the sewing machine;

a patch pivot assembly including a pivot plate rotatably mounted adjacent the sewing needle and movable in a downward direction for holding the locker patch and the garment in a fixed, overlaid relationship with respect to each other on said sewing platform, and for pivoting the locker patch and the garment in said fixed, overlaid relationship along the sewing path about an axis of rotation displaced from the sewing needle as the sewing needle sews about the arcuate edge of the locker patch to attach the locker patch to the garment;

a body gripper means pivotally mounted to the sewing machine displaced from said pivot plate and movable about the sewing path in conjunction with said pivot plate for engaging and pivoting the garment about the sewing machine while maintaining the waist portion of the garment in radial alignment with the locker patch and garment as the locker patch and garment are moved about the sewing path; and guide means for positioning the garment and the locker patch in an overlying relationship with the arcuate edge of the locker patch aligned with the sewing needle.

12. The system of claim 11 and further comprising drive means connected to said patch pivot plate and said body gripper means for driving said patch pivot plate and said body gripper means in combination.

13. The system of claim 11 and wherein said patch pivot assembly further comprises a cylinder mounted to the sewing machine and connected to said pivot plate at a position displaced from said axis of rotation of said pivot plate for moving said pivot plate between lowered and raised positions, and interchangeable patch plates adapted to releasably attach to said pivot plate for engaging and holding the locker patch and garment during pivoting and sewing.

14. The system of claim 11 and further including a drive mechanism mounted adjacent said sewing machine and connected to said patch pivot assembly and said body gripper means for rotating said pivot plate and said body gripper means in combination.

15. The system of claim 11 and further including a panel plate pivotally mounted adjacent the sewing machine and movable into engagement with a body portion of the garment overlying said work surface for maintaining the body portion of the garment in radial alignment with a neck portion of the garment disposed beneath the locker patch as the locker patch and the garment are moved about the sewing path.

16. The system of claim 11 and wherein said guide means includes a laser guide positioned above said sewing platform and which projects an optical guideline on the garment for positioning the arcuate edge of the locker patch on the garment in alignment with the sewing needle.

17. The system of claim 11 and further including means for adjusting the position of said locker patch pivot means, comprising a sliding plate assembly to which said patch pivot assembly means is mounted, said sliding plate assembly being movable laterally with respect to the sewing needle, and a crank member for moving said sliding plate assembly.

18. A method of automatically attaching a locker patch to a garment, comprising the steps of:

positioning a garment on a sewing platform of a sewing machine;

placing a locker patch on the garment in an overlying relationship with a first edge of the locker patch matched with a neck edge of the garment and a second edge of the locker patch aligned with the sewing path;

engaging the overlaid locker patch and garment with a pivot plate to secure the locker patch in a desired position on the garment for sewing;

engaging a body portion of the garment with a body pivot assembly;

advancing the locker patch and the body portion of the garment in conjunction with one another along a substantially arcuate sewing path beneath a sewing needle by rotating the pivot plate and body pivot assembly about an axis displaced from the sewing needle to maintain the neck and body portions of the garment in alignment as the locker patch is attached thereto; and as the locker patch and garment advance about their sewing path, sewing about the second edge of the locker patch to attach the locker patch to the garment.

19. The method of claim 18 and further including the step of cutting a thread attaching the locker patch to the garment after the locker patch has been attached to the garment.

20. The method of claim 18 and further comprising the steps of moving the garment away from the sewing machine once the locker patch has been attached to the garment and stacking the garment.

21. The method of claim 18 and wherein the step of placing the locker patch in an overlying relationship on the garment comprises:

aligning an arcuate edge of the locker patch with respect to the sewing needle via at least one optical guide;

aligning the arcuate edge of said locker patch with an alignment channel of an alignment adapter attached to a presser foot of the sewing machine; and aligning a straight edge of the locker patch with a rear edge of the alignment adapter.

22. The method of claim 18 and further including the step of moving the pivot plate laterally with respect to the sewing needle to adjust the position of the pivot plate to accommodate locker patches of varying sizes.

23. A system for automatically attaching a locker patch having an arcuate edge to a neck portion of a garment, comprising:

a sewing machine having a presser foot and a sewing needle and defining a sewing path extending through said sewing needle;

means for holding and pivoting the locker patch and neck portion of the garment, positioned adjacent said sewing needle and adapted to be moveable vertically into engagement with the locker patch to secure the locker patch in position at the neck portion of the garment and rotatable about an axis of rotation displaced from said sewing needle for moving the locker patch and neck portion of the garment along said sewing path;

means for holding and moving a body portion of the garment in relation to the movement of the locker patch, positioned outside of said sewing path and rotatable in conjunction with said means for holding and pivoting the locker patch and neck portion of the garment about said axis of rotation; and means for aligning the locker patch and neck portion of the garment with said sewing path.

24. The system of claim 23 and wherein said means for holding and pivoting the locker patch and neck portion of the garment comprises a pivot plate, a patch plate releasably mounted to said pivot plate for engaging and holding the locker patch and garment during rotation, a cylinder connected to said pivot plate at a position displaced from said axis of rotation for raising and lowering said pivot plate and its patch plate into and out of engagement with the locker patch and a drive shaft on which said pivot plate is movably mounted for rotating said pivot plate.

25. The system of claim 23 and further including a slidable plate assembly on which said means for holding and pivoting is mounted, and a crank member for moving said slidable plate assembly laterally to move said means for holding and pivoting with respect to said sewing needle to accommodate locker patches of varying sizes.

26. The system of claim 23 and wherein said means for holding and moving the garment comprises a panel plate adapted to engage a body portion of the garment and rotate the body portion of the garment in alignment with the locker patch and neck portion of the garment as the locker patch is sewn to the neck portion of the garment.

27. The system of claim 23 and wherein said means for holding and moving the garment further includes a body gripping arm movably mounted about said sewing machine and adapted to be moveable into engagement with a waist portion of the garment and to move the waist portion of the garment about an arcuate path of movement substantially parallel to said sewing path as the locker patch and neck portion of the garment are moved along said sewing path.

28. The system of claim 23 and wherein said means for aligning comprises light guides that project optical guides on the garment for aligning the locker patch on the garment with respect to said sewing needle.

29. The system of claim 23 and wherein said means for aligning includes an alignment adapter attached to said presser foot of said sewing machine and having a first edge with which the garment is aligned and an alignment channel adapted to receive an edge of the locker patch therein for positioning the edge of the locker patch along the sewing path in alignment with said sewing needle prior to starting a sewing operation.

30. The system of claim 23 and further comprising sensor means for detecting when said garment is in place on said sewing platform.

31. A method of attaching a locker patch to a garment with a sewing machine, comprising the steps of:

placing the locker patch and garment in a sewing path aligned with a sewing needle;

aligning edges of the locker patch and garment with the sewing path by locating the edges of the locker patch along the sewing path with a three point alignment;

engaging and holding the locker patch against a neck portion of the garment with a pivot means;

moving the locker patch and neck portion of the garment in a substantially arcuate motion about the sewing path past the sewing needle wherein the locker patch is attached to the neck portion of the garment; and as the locker patch and neck portion of the garment are moved about the sewing path, engaging and moving a body portion of the garment in conjunction with the movement of the locker patch and neck portion of the garment.

32. The method of claim 31 and wherein the step of locating the edges of the locker patch with a three point alignment comprises:

aligning the straight edge of the locker patch with the neck line of the garment and with a straight edge of an alignment adapter attached to the sewing machine;

aligning one side of the arcuate edge of the locker patch with a channel along one side of the alignment adapter; and aligning the arcuate edge of the locker patch with optical guide lines projected onto the garment and generated by light guides mounted to the sewing machine.

33. The method of claim 31 and further including the step of cutting a thread attaching the locker patch to the garment after the locker patch has been attached to the garment.

34. The method of claim 33 and wherein the steps of engaging and holding the locker patch against the garment and engaging and moving the body portion of the garment comprises engaging the locker patch and neck portion at a first level and engaging the body portion comprises engaging the body portion of the garment at a second level lower than said first level.

35. The method of claim 31 and wherein the step of engaging and moving a body portion of the garment comprises engaging the garment with a panel plate on an opposite side of the sewing path from the pivot means and rotating the panel plate with the rotation of the pivot means to move the body portion of the garment about an arcuate path as the locker patch and neck portion of the garment are moved along the sewing path.

36. The method of claim 35 and wherein the step of engaging and moving the body portion further includes the steps of engaging a waist portion of the garment and moving the waist portion about a substantially arcuate path in conjunction with the movement of the locker patch and neck portion of the garment about the sewing path.

37. A system for attaching a larger garment part to a smaller garment part, said system comprising:

a sewing machine;

means for aligning the larger garment part and the smaller garment part with each other at the needles of the sewing machine;

an upper shelf substantially coextensive with and surrounding the bed of the sewing machine for supporting the smaller garment part and a portion of the upper portion of the larger garment part and defining an arcuate edge;

a lower shelf positioned parallel to and below said upper shelf for supporting the lower portion of said larger garment part;

means for pivoting the larger and smaller garment parts about a common axis displaced from said sewing needles; and means for moving the lower portion of said larger garment part on said lower shelf in an arc about said sewing needles in unison with the pivoting of the larger and smaller garment parts about the common axis.

38. The system of claim 37 and further including a means for adjusting the position of said means for pivoting the larger and smaller garment parts relative to the presser foot and the sewing needle to accommodate locker patches of varying sizes.

39. The system of claim 38 and wherein said means for adjusting the position of said means for pivoting the larger and smaller garment parts comprises a sliding plate assembly to which said means for pivoting the larger and smaller garment parts is mounted, said sliding plate assembly being movable laterally with respect to the sewing needle, and a crank member for moving said sliding plate assembly.

40. The system of claim 37 and wherein said means for pivoting the larger and smaller garment parts includes a pivot plate, a patch plate releasible mounted to said pivot plate for engaging and holding the locker patch and garment during rotation, a cylinder connected to said pivot plate at a position displaced from said axis of rotation for raising and lowering said pivot plate and its patch plate into and out of engagement with the locker patch and a drive shaft on which said pivot plate is movably mounted for rotating said pivot plate.

* * * * *